US008474937B2

(12) United States Patent
Jeong et al.

(10) Patent No.: US 8,474,937 B2
(45) Date of Patent: Jul. 2, 2013

(54) APPARATUS FOR AND METHOD OF CONTROLLING JETTING OF INK IN INKJET PRINTER

(75) Inventors: Yong-Won Jeong, Seoul (KR); Hyung Choi, Seongnam-Si (KR); Yong-Seop Yoon, Seoul (KR); Moon-Chul Lee, Seongnam-Si (KR); Dong-Shik Shim, Suwon-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 679 days.

(21) Appl. No.: 12/367,907

(22) Filed: Feb. 9, 2009

(65) Prior Publication Data

US 2010/0002036 A1 Jan. 7, 2010

(30) Foreign Application Priority Data

Jul. 4, 2008 (KR) ..... 10-2008-0065137

(51) Int. Cl.
*B41J 29/38* (2006.01)

(52) U.S. Cl.
USPC ..... 347/14; 347/19

(58) Field of Classification Search
USPC ..... 347/14, 19
See application file for complete search history.

(56) References Cited

U.S. PATENT DOCUMENTS

| | | | | |
|---|---|---|---|---|
| 5,706,043 | A * | 1/1998 | Okada et al. | 347/185 |
| 5,790,166 | A * | 8/1998 | Nacman | 347/255 |
| 5,850,242 | A * | 12/1998 | Asaba | 347/59 |
| 6,076,922 | A * | 6/2000 | Knierim | 347/103 |
| 6,439,679 | B1 * | 8/2002 | Roylance | 347/9 |

* cited by examiner

*Primary Examiner* — Laura Martin
(74) *Attorney, Agent, or Firm* — Staas & Halsey LLP

(57) ABSTRACT

Provided are an apparatus and method of controlling jetting of ink of an inkjet printer. The apparatus includes at least one print head chip, which includes a temperature sensor for sensing the temperature of the print head chip and a voltage controlled oscillator (VCO) for converting the sensed temperature to a frequency component. The apparatus may also include a counter, which converts the frequency component to a code information using a reference frequency component, and a controller, which controls the ink jetting operation of the at least one print head chip based on the code information and/or the frequency component.

17 Claims, 5 Drawing Sheets

APPARATUS FOR AND METHOD OF CONTROLLING JETTING OF INK IN INKJET PRINTER

CROSS-REFERENCE TO RELATED PATENT APPLICATION

This application claims the benefit of Korean Patent Application No. 10-2008-0065137, filed on Jul. 4, 2008, in the Korean Intellectual Property Office, the disclosure of which is incorporated herein in its entirety by reference.

TECHNICAL FIELD

The present general inventive concept relates to an image forming apparatus, and more particularly, to apparatus for and method of controlling a plurality of print head chips so as to reduce the effect of temperature variance.

BACKGROUND OF RELATED ART

In conventional inkjet printers utilizing jetting of liquid ink, proper temperature control may be required in order to maintain a uniform printing because the viscosity of the liquid ink in the inkjet head chip changes according to the ambient and/or head chip temperatures. The temperature related viscosity change affects the drop volume of the ejected ink, and as a result, affects the quality of an image printed on a printing medium, such as, e.g., on a sheet of a paper. For example, when temperature increases, the viscosity of ink tends to decrease, and thus the ejection amount according to each nozzle may increase. As a result, the resulting output image may have a higher optical density. On the other hand, when temperature decreases, the viscosity of ink tends to increase, and thus, the ejection amount according to each nozzle may decrease, resulting in the output image having a lower optical density.

When printouts are repeatedly outputted in a high speed/high resolution mode, the temperature of a head chip may gradually increase, and when the temperature exceeds certain level, a stable ink ejection cannot be expected, and it may thus become necessary to stop the printing operation for certain cooling time.

Moreover, when an array of head chips are employed, e.g., in a wide array printer, temperatures between adjacent head chips may differ, and such different temperatures may result in an inferior image quality. Accordingly, the controlling of temperature may be of a greater concern, e.g., for a wide array printer than it would be e.g., for a shuttle type printer.

Generally speaking, synchronization of the head chip(s), the CPU and other mechanical device(s), e.g., the motor is based on the system clock frequency. Information with respect to the location on a printing medium on which to eject ink is converted to a signal assigning the nozzle location of each head chip and a load signal according to timing requirement.

For example, FIG. 1 illustrates control signal synchronization based on the system clock frequency SCLK for one nozzle. Each nozzle generates ink bubbles when a current flows through a heater. The process is controlled by the on/off time of a Fire-pulse signal. The Fire-pulse signal shown in FIG. 1 includes a T_warm time, a T_fire time, and a T_No fire time. During the T_warm time, the head chip is preheated to a predetermined temperature before the supply of the bubble generation amount of current to the heater. A warming up signal during the T_warm time is called a Fire_start signal. The Fire_start signal increases the temperature of a chip without generating the bubbles, and thus a current lower than the current for ejecting bubbles of the ink is supplied during the T_warm time. During the T_fire time, the bubbles are generated in the heater and drops of the ink are ejected. The Fire_On signal is the current signal for generating the bubbles, and the Fire_On_Add signal is a signal to compensate for a margin of ejection point of time between chips and or between nozzles. Accordingly, the T_fire time, i.e., the total time of supplying the current to the heater, is obtained by adding the times in which the Fire_On signal and the Fire_On_Add signal are turned on. The T_No fire time is not a time during which an electric physical signal is applied to the heater, but a time obtained by adding the refill time necessary for re-supplying the ink, and the nozzle meniscus stabilizing time. As shown in FIG. 1, even when the ejection amount of the ink may be affected by the temperature, the control signals applied to the head chips do not take the temperature into account.

Briefly, the control algorithm based on the temperature includes the following. When a print request signal is received, a determination as to whether the head chip is overheated. When the head chip is overheated beyond certain threshold temperature, the printer halts the operation, and when the head chip cools down below the threshold temperature, the printer resumes operating. The image quality may also deteriorate when the viscosity of ink increases, or when the temperature of the head chip becomes too low, and thereby, reducing the amount of the ink ejected. Accordingly, to raise the temperature of the head chip is increased by applying a pulse for increasing the temperature of the heater or by ejecting the ink. The above is an algorithms generally employed for a shuttle printer, and allows the printer to operate only within a predetermined window of operating temperature range, and halts the operation of the printer outside the temperature range.

In a wide array printer, each head chip is assigned to a portion of a row of an output pattern, unlike a shuttle printer, in which one head chip outputs all of the pattern by shuttling across the row. Thus, in a wide array printer depending on the particular pattern, it is possible that only specific ones of the head chips may be heated.

For example, in FIG. 2, example pattern outputs (a) and (b) illustrate the performance difference between one page to the next. Referring to FIG. 2(*a*), the image pattern calls for only specific head chips A, C and E to eject ink, thus, increasing the temperatures of only the head chips A, C and E. FIG. 2(*b*) illustrates an effect of the increased temperature of the head chips A, C and E on the output image of the next page. Even when the entire image having a uniform light color is intended, the optical density of image output by the heated head chips A, C and E is different (i.e., darker) from the optical density of the image output from head chips B, D and F. In other words, the head chips A, C and E have a higher optical density than the head chips B, D, and F due to the drop volume increase. When there is an optical density difference between adjacent head chips despite of the same input, lines appear in the image between the head chips, and thus, the resulting image pattern may appear distorted and different from the intended original image.

SUMMARY

According to an aspect of the present general inventive concept, there is provided an apparatus for controlling jetting of ink of an inkjet printer, the apparatus may include: at least one print head chip, which comprises a temperature sensor for sensing temperature and a voltage controlled oscillator (VCO) for converting the sensed temperature to a frequency component; a counter configured to convert the frequency component to a code information; and a controller configured control timing of ink ejection by the at least one print head chip based on the code information.

The at least one print head chip may comprise a plurality of print head chips. The apparatus may further include a comparator configured to compare respective code information corresponding to each of the plurality of print head chips. The controller may control the timing of ink ejection for one or more of the plurality of print head chips based on the code information corresponding to a select one of the plurality of print head chips selected based on the result of the comparison by the comparator.

The controller may delay the timing of ink ejection when the temperature of the select one of the plurality of print head chips is higher than a predetermined temperature. The controller may advance the timing of ink ejection when the temperature of the select one of the plurality of print head chips is lower than the predetermined temperature.

The controller may also control the feeding speed of the printing medium based on the code information.

The controller may decrease the feeding speed of the printing medium when the temperature of the select one of the plurality of print head chips is higher than a predetermined temperature. The controller may increase the feeding speed of the printing medium when the temperature of the select one of the plurality of print head chips is lower than the predetermined temperature.

The temperature sensor may comprise a complimentary metal-oxide-semiconductor (CMOS) lateral bipolar junction transistor (BJT).

The controller may determine whether a difference between the highest frequency and the lowest frequency from among frequencies corresponding to the plurality of print head chips is equal to or greater than a first threshold value, and, when it is determined that the difference is equal to or greater than the first threshold value, may cause the plurality of print head chips to switch to a standby mode.

The controller may determine whether the lowest frequency from among frequencies corresponding to the plurality of print head chips is equal to or below a second threshold value, and when it is determined that the lowest frequency is equal to or below the second threshold value, may cause the plurality of print head chips to switch to a standby mode.

According to another aspect, an image forming apparatus may include a plurality of print head chips, each of which comprises a temperature sensor for sensing temperature and a voltage controlled oscillator (VCO) for converting the sensed temperature to a frequency component; a counter configured to convert each frequency component corresponding to respective one of the plurality of print head chips into a code information; and a controller configured control timing of ink ejection by the plurality of print head chips based the code information corresponding to at least one of the plurality of print head chips.

According to yet another aspect, a method of controlling jetting of ink of an inkjet printer may comprise: sensing a temperature of at least one print head chip; converting the sensed temperature into a frequency component; converting the frequency component into a code information by using a reference frequency component; and controlling timing of ink ejection by the at least one print head chip based on the code information.

The at least one print head chip may comprise a plurality of print head chips. The method may further comprise: comparing respective code information corresponding to each of the plurality of print head chips. The timing of ink ejection for one or more of the plurality of print head chips may be controlled based on the code information corresponding to a select one of the plurality of print head chips selected based on the result of the comparison by the comparator.

The step of controlling the timing of ink ejection may comprise: delaying the timing of ink ejection when the temperature of the select one of the plurality of print head chips is higher than a predetermined temperature; and advancing the timing of ink ejection when the temperature of the select one of the plurality of print head chips is lower than the predetermined temperature.

The method may further comprise controlling the feeding speed of the printing medium based on the code information.

The step of controlling the feeding speed of the printing medium may comprise: decreasing the feeding speed of the printing medium when the temperature of the select one of the plurality of print head chips is higher than a predetermined temperature; and increasing the feeding speed of the printing medium when the temperature of the select one of the plurality of print head chips is lower than the predetermined temperature.

The method may further comprise: determining whether the difference between the highest frequency and the lowest frequency from among frequencies corresponding to the plurality of print head chips is equal to or greater than a first threshold value; and causing the plurality of print head chips to switch to a standby mode when the difference is determined to be equal to or greater than the first threshold value.

The method may further comprise: determining whether the lowest frequency from among frequencies corresponding to the plurality of print head chips is equal to or below a second threshold value; and causing the plurality of print head chips to switch to a standby mode when the lowest frequency is determined to be equal to or below the second threshold value.

According to yet another aspect, a computer readable recording medium may be provided to have recorded thereon a program for executing a method of controlling jetting of ink of an inkjet printer. The method may comprise: sensing a temperature of at least one print head chip; converting the sensed temperature into a frequency component; converting the frequency component into a code information by using a reference frequency component; and controlling timing of ink ejection by the at least one print head chip based on the code information.

According to even yet another aspect, a method of controlling jetting of ink of an inkjet printer may comprise sensing a temperature of at least one print head chip; converting the sensed temperature into a frequency component; and adjusting, based on the frequency component, a duration of a fire-on time during which a current is supplied to a heater of the at least one print head chip.

The at least one print head chip may have an operational cycle, the operational cycle including a first period during which the heater does not receive the current and a second period during which the current is supplied to the heater. The step of adjusting the duration of the fire-on time may comprise: synchronizing the operational cycle of the at least one print head chip with the frequency component.

The at least one print head chip may comprise a plurality of print head chips. The method may further comprise: comparing respective frequency component corresponding to each of the plurality of print head chips with one another; and selecting based on the comparison a select one of the plurality of print head chips. The step of synchronizing the operational cycle may comprise synchronizing the operational cycle of each of the plurality of print head chips with the frequency component corresponding to the select one of the plurality of print head chips.

The frequency component corresponding to the select one of the plurality of print head chips may have the lowest frequency among frequency components of the plurality of print head chips.

The method may further comprise: determining whether the difference between the highest frequency and the lowest frequency from among frequencies corresponding to the plurality of print head chips is equal to or greater than a first threshold value; and causing the plurality of print head chips to switch to a standby mode when the difference is determined to be equal to or greater than the first threshold value.

The method may further comprise: determining whether the lowest frequency from among frequencies corresponding to the plurality of print head chips is equal to or below a second threshold value; and causing the plurality of print head chips to switch to a standby mode when the lowest frequency is determined to be equal to or below the second threshold value.

The method may further comprise: adjusting a feeding speed of a printing medium based on the frequency component.

BRIEF DESCRIPTION OF THE DRAWINGS

Various aspects of the present disclosure will become apparent and more readily appreciated from the following description of the embodiments, taken in conjunction with the accompanying drawings, of which.

DETAILED DESCRIPTION OF SEVERAL EMBODIMENTS

Figure 1:
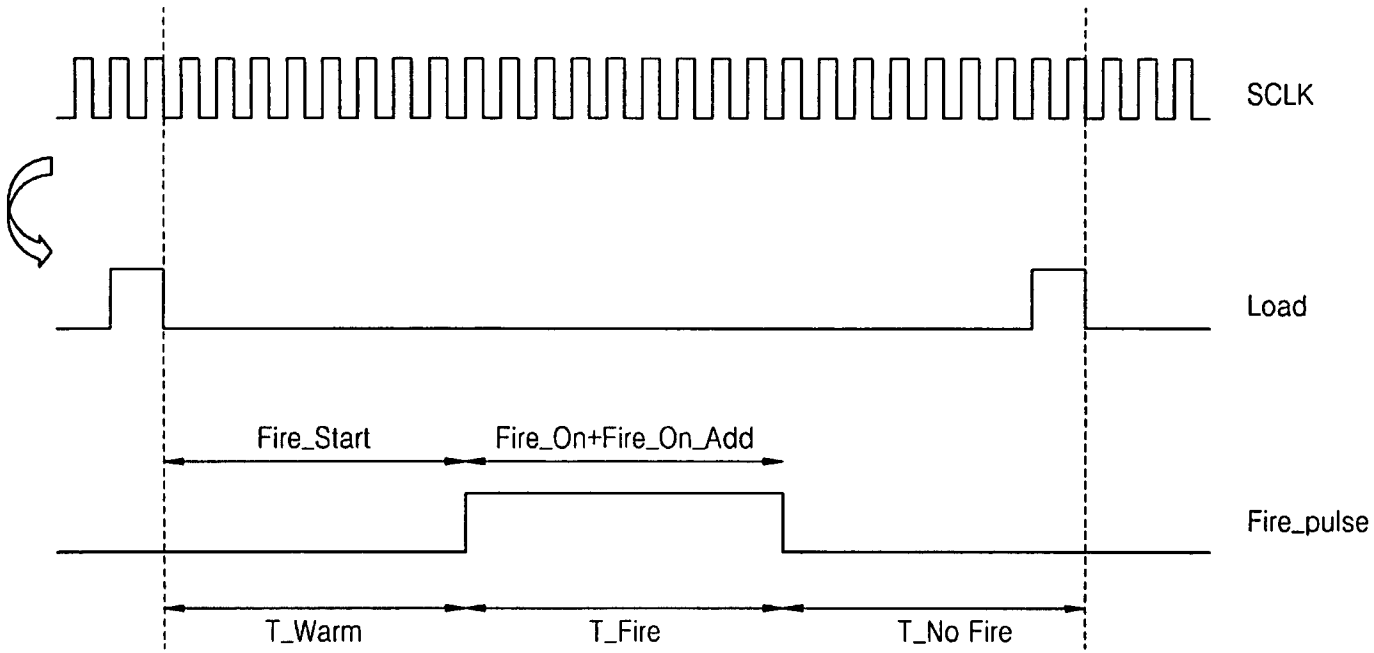
FIG. 1 illustrates the control signal synchronization for a nozzle based on the system clock frequency.
Figure 2:
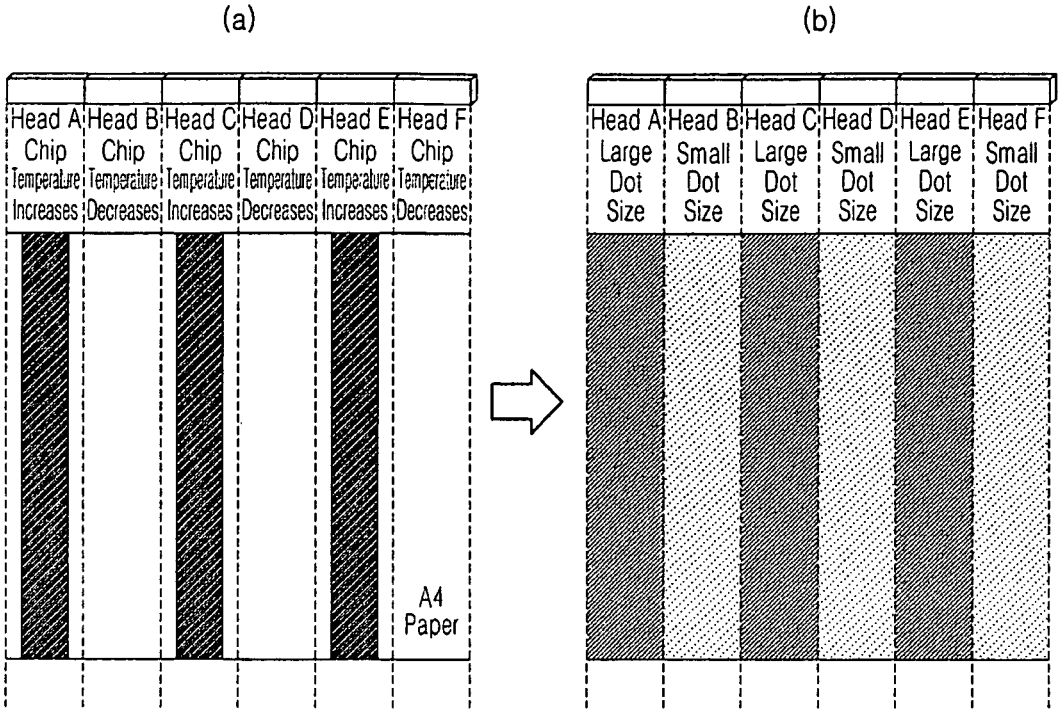
FIGS. 2(*a*) and (*b*) are diagrams for describing a performance difference between head chips of different temperatures.

Reference will now be made in detail to embodiments of the present invention, examples of which are illustrated in the accompanying drawings, wherein like reference numerals refer to like elements. While the embodiments are described with detailed construction and elements to assist in a comprehensive understanding of the various applications and advantages of the embodiments, it should be apparent however that the embodiments can be carried out without those specifically detailed particulars. Also, well-known functions or constructions will not be described in detail so as to avoid obscuring the description with unnecessary detail.

Figure 3:
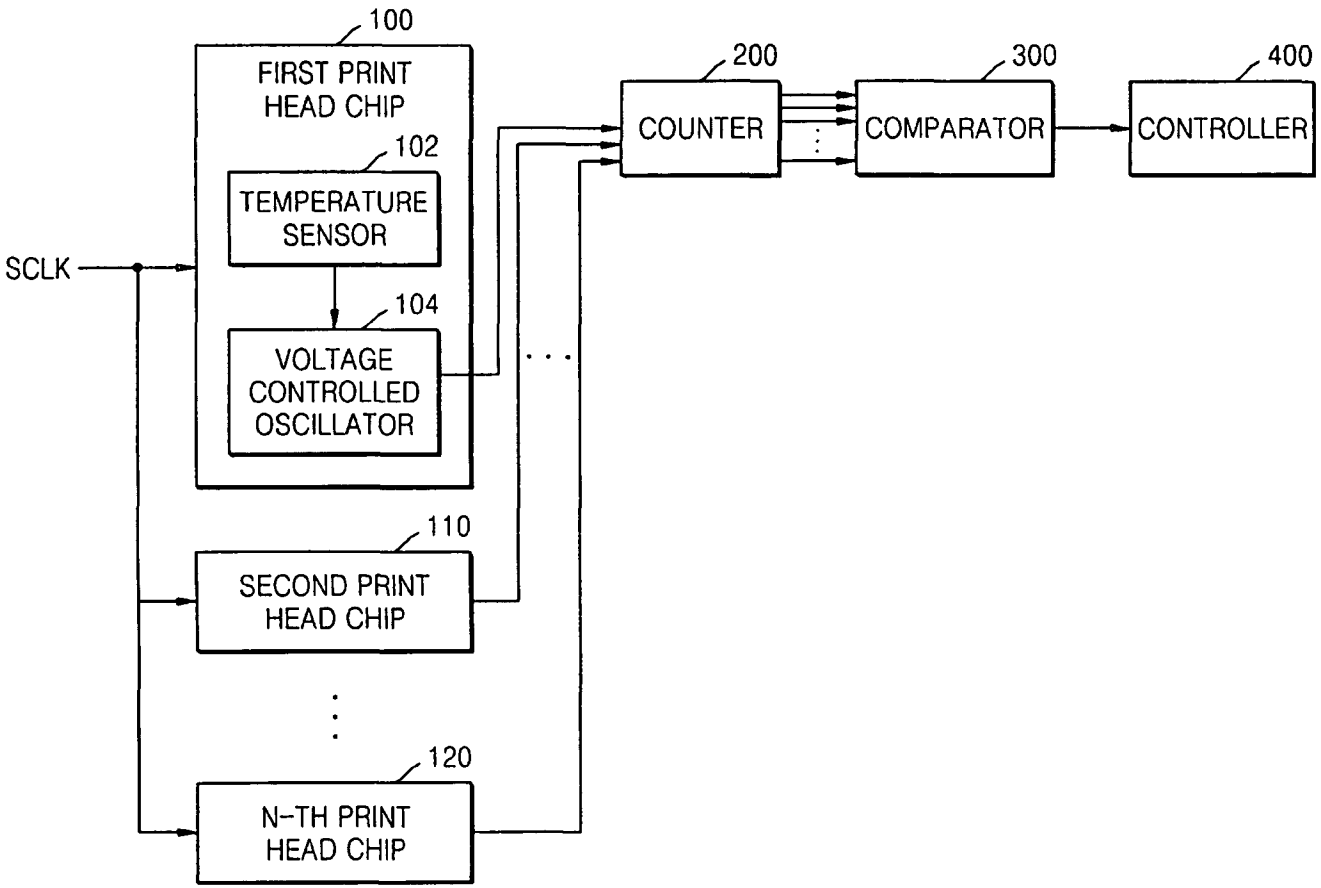
FIG. 3 is a block diagram illustrating an apparatus for controlling jetting of ink of an inkjet printer according to an embodiment of the present invention.

FIG. 3 is a block diagram illustrating an apparatus for controlling jetting of ink of an inkjet printer according to an embodiment. The apparatus may include first through N-th print head chips 100 through 120, a counter 200, a comparator 300 and a controller 400.

Each of the first through N-th print head chips 100 through 120 may include a temperature sensor for measuring temperature and a voltage controlled oscillator (VCO) for converting the measured temperature to a frequency component. For example, as illustrated in FIG. 3, the first print head chip 100 includes a temperature sensor 102 and a VCO 104.

The temperature sensor 102 may be, according to an embodiment, a complimentary metal-oxide-semiconductor (CMOS) lateral bipolar junction transistor (BJT), i.e., a CMOS type BJT, which is a BJT fabricated using the CMOS technology. In the CMOS type BJT, the high switching speed, one of advantages of the conventional BJT, may be reduced somewhat, but the excellent temperature characteristic of the conventional BJT is retained. Also, since the CMOS type BJT can be manufactured by using a CMOS process, a monolithic integration with the signal processing circuitries by the use of the same fabrication process is possible. The CMOS type BJT includes a CMOS vertical BJT and a CMOS lateral BJT. According to an embodiment, the CMOS lateral BJT is used in so as to reduce the chip size. Comparing the sizes of the CMOS vertical BJT and the CMOS lateral BJT manufactured using the CMOS process, the size of the CMOS lateral BJT is remarkably smaller than that of the CMOS vertical BJT. According to an embodiment, the CMOS lateral BJT may be disposed adjacent to a feedhole of a print head chip. The small size of a CMOS lateral BJT may allow the placement thereof without having to specifically provide the space that would otherwise be required for other types of sensor devices. A CMOS lateral BJT may even be placed adjacent each individual nozzle for temperature sensing of each individual nozzle.

The VCO 104 converts a voltage outputted from the temperature sensor 102, to a frequency component, and outputs the frequency component. To that end, the VCO 104 may include a buffer (not shown), a Schmitt trigger (not shown), an RC integrator (not shown), and a CMOS voltage divider (not shown), and converts the DC voltage output from the temperature sensor 102 to the frequency component for further processing. The frequency component may exhibit, for example, a frequency that decreases when the temperature increases, and which increases when the temperature decreases. The frequency component output from the VCO 104 is output to the counter 200.

the temperature sensors (not shown) and VCOs (not shown) of the second through N-th print head chips 110 through 120 may also convert their corresponding temperature information to frequency components, and output their respective frequency components to the counter 200.

The counter 200 converts temperatures of the frequency components output from the first through N-th print head chips 100 through 120 to code information using a reference frequency component. A code information may be a digitalized frequency indicative of information relating to the temperature. In order to convert a frequency component output to a code information, the counter 200 may require a sampling frequency as the reference frequency component. A separate frequency source may be provided or the system clock frequency SCLK may be used as the sampling frequency. The counter 200 transmits the code information of each frequency component to the comparator 300.

The comparator 300 compares each code information corresponding to respective one of the first through N-th print head chips 100 through 120, detects a print head chip having a predetermined frequency according to the comparison result, and transmits information about the detected print head chip to the controller 400. For example, the comparator 300 detects a print head chip having the lowest frequency. For example, according to an embodiment, the print head chip having the lowest frequency may mean that the print head has the highest temperature because the frequency is inversely proportional to the temperature, that is, in this particular example, the frequency is low when the temperature is high, and the frequency is high when the temperature is low.

Based on the comparison result from the comparator 300, the controller 400 controls the ejection command to the first through N-th print head chips 110 through 120. For example, the controller 400 may control the ejection command based on the print head chip having the lowest frequency, i.e., the print head chip having the highest temperature. That is, in this example, the controller 400 may delay or advance the timing of the ejection command based on the temperature of the print head chip having the highest temperature. As the temperature of the print head chip becomes higher and higher, there is the possibility that the drop volume may increase, and thus the printing speed should be decreased so that the temperature does not continue to rise. In that case, the controller 400 further delays the timing of the ejection command. On the other hand, however, as the temperature of a print head chip becomes lower and lower, the drop volume may decrease, and thus the printing speed should be increased so that the temperature does not continue to decrease. Accordingly, the controller 400 in that situation further advances the timing of the ejection command.

Figure 4:
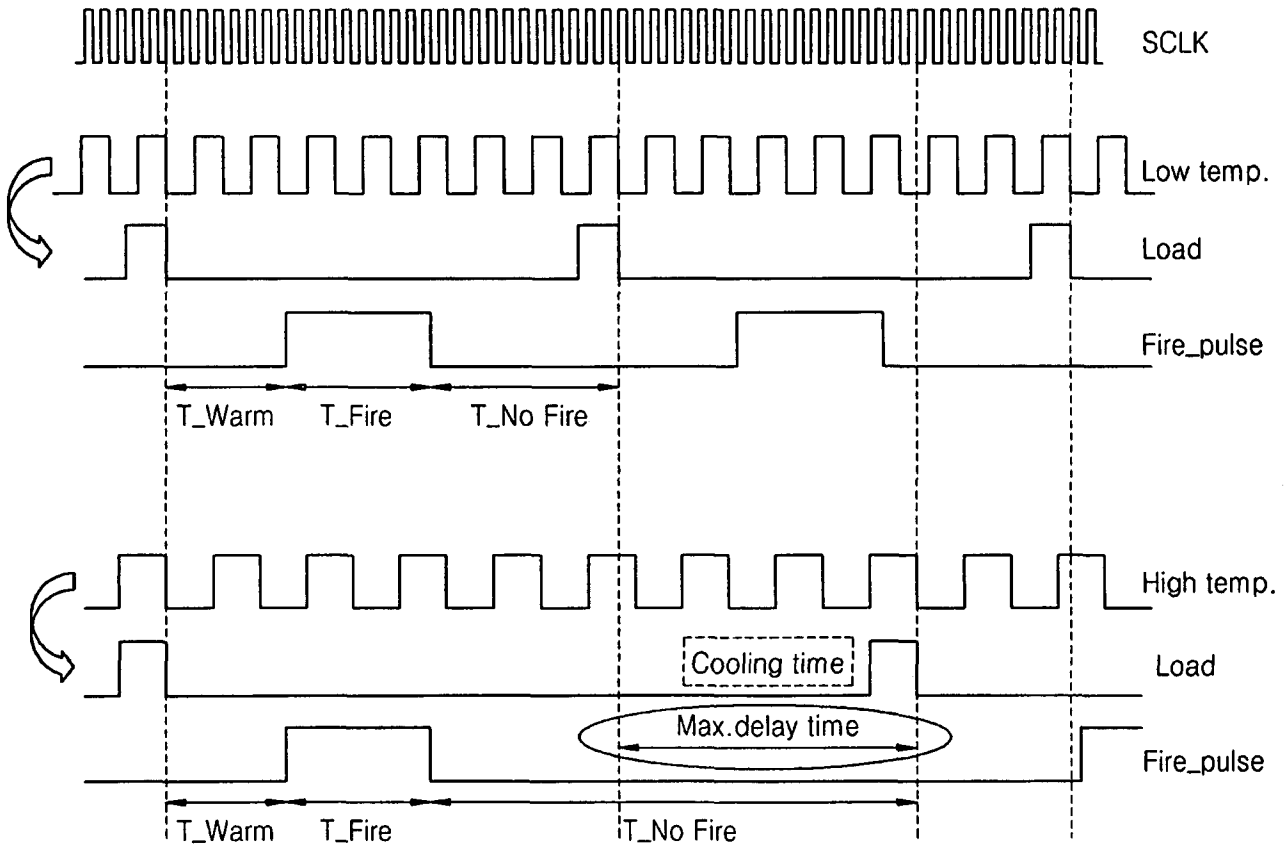
FIG. 4 is a timing diagram illustrating controlling of ink jetting timing in consideration of temperature in a print head chip according to an embodiment.

For example, the timing diagram shown in FIG. 4 illustrates controlling of ink jetting timing in consideration of temperature in a print head chip according to an embodiment.

In comparison to FIG. 1, the timing diagram of FIG. 4 further includes the frequencies indicative of the temperature (e.g., of the head chip having the highest temperature). Values of such frequencies are indicated as Low temp. and High temp., and examples of processing a signal at a low temperature and a high temperature are illustrated. As illustrated in FIG. 4, unlike FIG. 1 where a reference frequency is only one system clock frequency SCLK, the LOAD signal that controls the timing of the ejection command is synchronized with the temperature frequency component, rather than with the system clock frequency SCLK. For example, since the frequency of High temp. is much lower than that of Low temp., the period of a LOAD signal of the High temp. is also lower than that of the Low temp. This means that the output frequency decreases at the high temperature.

The Fire_pulse, which is the signal representing the current flowing through the heater, begins its signal cycle with the LOAD signal being turned on. The T_fire time, which is the time duration during which the current flows through the heater during the Fire_pulse cycle, may be synchronized with the system clock frequency SCLK. As a result of the Fire_pulse signal cycle being synchronized with the temperature frequency component, the T_No Fire time, which is the time duration in the Fire_pulse cycle during which the current does not flow through the heater, is longer for the High temp. case than the Low temp. case. The longer T_No fire time allows a sufficient time for the high temperature of the print head chip to cool down. Since the output value of each temperature sensor and the LOAD pulse can be generated in real time during the operation of the inkjet printer, the temperature can thus be continuously controlled in real time. Through above processes, it is possible to continuously control the temperature of the print head chips, and/or, in a similar manner, the temperature of the nozzles.

According to an embodiment, the controller 400 may control the feeding speed of the printing medium according to the comparison result of the comparator 300. That is, the controller 400 may gradually decrease the feeding speed when the temperature of the print head chip having the highest temperature becomes higher, and may gradually increase the feeding speed when the temperature of the print head chip having the highest temperature becomes lower based on the temperature frequency component corresponding to the head chip having the highest temperature. That is, as the temperature of a print head chip becomes higher, the printing speed should be decreased so that the temperature does not continue to increase. Accordingly, the controller 400 further decreases the feeding speed in order to decrease the printing speed. On the other hand, however, as the temperature of a print head chip becomes lower, the printing speed should be increased so that the temperature does not continue to decrease. Accordingly, the controller 400 further increases the feeding speed in order to increase the printing speed.

It should be noted that in the above described embodiments, the controller 400 may use either the frequency component itself or the code information representation thereof for the head chip, e.g., in the example above, the head chip with the highest temperature, selected as the basis for controlling the timing of ejection command and/or the feeding speed of the print medium. Further, the controller 400 may be, e.g., a microprocessor, a microcontroller or the like, that includes a CPU to execute one or more computer instructions to implement the control operations herein described, and may further include a memory device and/or circuit, e.g., a Random Access Memory (RAM), Read-Only-Memory (ROM), a flesh memory, or the like, to store the one or more computer instructions. According to an embodiment, the controller may serve as the main controller for the inkjet printer, and perform other aspects of controlling the inkjet printer. Structures and operations of such controller is familiar to one skilled in the art; therefore, detailed descriptions thereof is not necessary.

Referring back to FIG. 3, according to an embodiment, the controller 400 may determine whether the difference between the highest frequency and the lowest frequency from among frequencies corresponding to the first through N-th head chips 100 through 120 is equal to or above a first threshold value, and when the difference is equal to or above the first threshold value, may place the first through N-th print head chips 100 through 120 in an inactive or a standby mode. According to an embodiment, the controller 400 may determine whether the lowest frequency is equal to or below a second threshold value, and when the lowest frequency is equal to or below the second threshold value, may place the first through N-th print head chips 100 through 120 in a standby mode.

For example, the first through N-th print head chips 100 through 120 may be placed in the standby mode in order to decrease the temperature, when a certain pattern is printed out on numerous of pages by repeatedly using specific print head chips, or when all of the first through N-th print head chips 100 through 120 exceed a critical temperature. For example, when the difference between the highest frequency and the lowest frequency, i.e., the difference between the lowest temperature and the highest temperature, exceeds certain amount, e.g., 5° C., the controller 400 may stop the printing operation, and place the first through N-th printing head chips 100 through 120 in the standby mode. When the lowest frequency, i.e., the highest temperature, exceeds a critical temperature, the controller 400 may also stop the printing operation, and place the first through N-th printing head chips 100 through 120 in the standby mode.

The apparatus describe above may be used in an image forming apparatus including, e.g., a wide array type printer employing multiple head chips.

Figure 5:
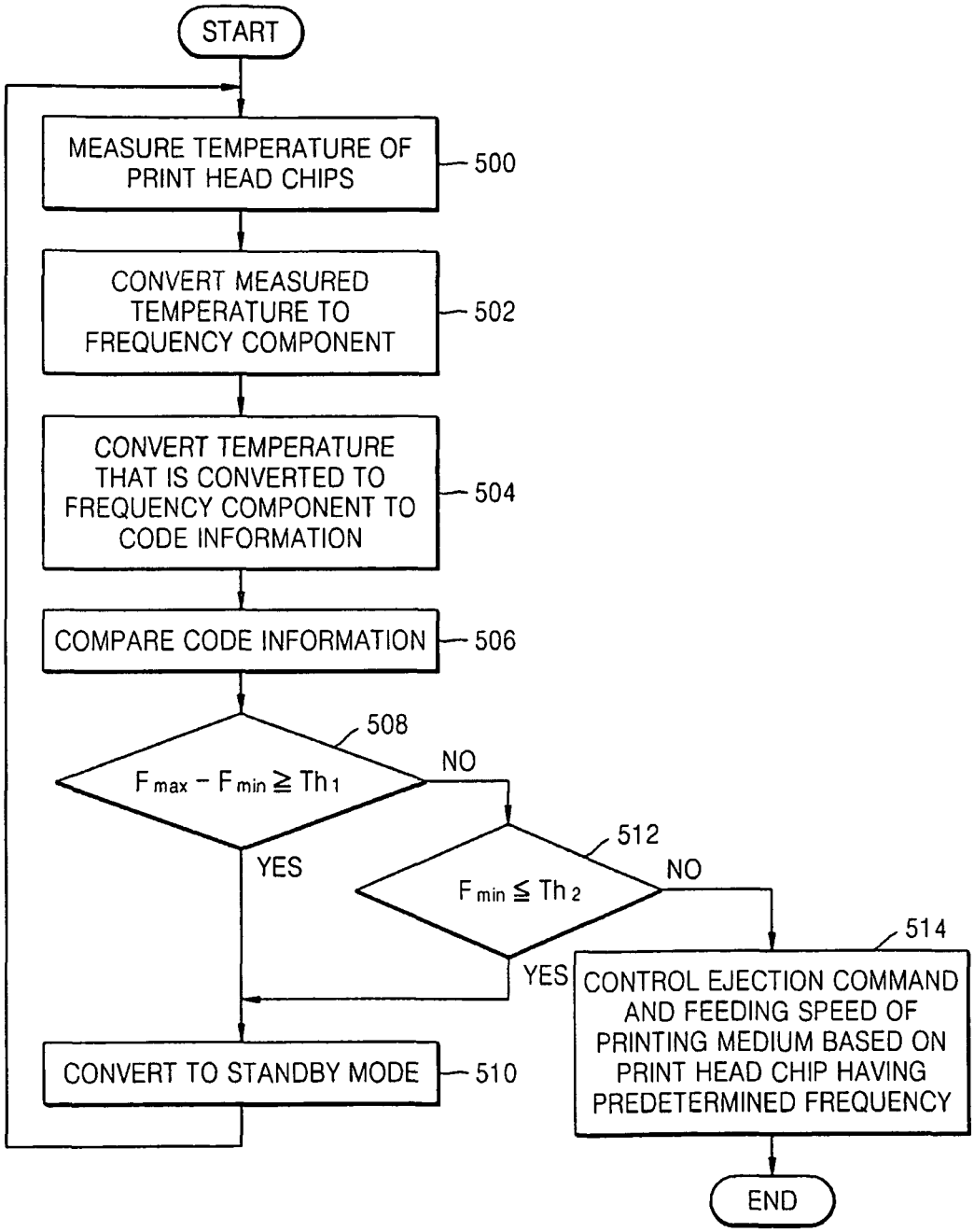
FIG. 5 is a flowchart of a method of controlling jetting of ink in an inkjet printer according to an embodiment.

A method of controlling the jetting of ink in an inkjet printer according to an embodiment will now be described with reference to the flow chart shown in FIG. 5.

First, in operation 500, the temperature of at least one print head chip is sensed with a temperature sensor, such as, e.g., a CMOS lateral BJT.

Then, the measured temperature is converted to a frequency component, in operation 502. For example, the voltage corresponding to the temperature may be converted to a frequency signal by using a VCO.

In operation 504, the temperature that is converted to the frequency component is converted to code information based on a reference frequency component. The code information may be a digitalized frequency indicative of the temperature. As the reference frequency for obtaining the code information, a sampling frequency may be required. The sampling frequency may be obtained from a separately provided frequency signal source or the system clock frequency may be used as the sampling frequency.

In operation 506, the code information corresponding to the print head chips are compared to each other. In other words, the code information corresponding to each print head chip, i.e., the values of the frequencies are compared to each other.

In operation 508, it is determined whether the difference between the highest frequency $F_{max}$ and the lowest frequency $F_{min}$ from among frequencies corresponding to the print head chips is equal to or above a first threshold value $Th_1$ based on the comparison result of operation 506. The first threshold value $Th_1$ may be chosen so as to determine whether to place the print head chips in the standby mode, and may be, e.g., 40 KHz. For example, it is determined whether the difference between the highest frequency $F_{max}$ and the lowest frequency $F_{min}$ is equal to or above 40 KHz (when expressed in terms of temperature, approximately 5° C.) corresponding to the first threshold value $Th_1$.

If in operation 508 the difference is found to be equal to or above the first threshold value $Th_1$, the print head chips are placed in the standby mode in operation 510. The difference being equal to or above the first threshold value $Th_1$ means that the difference between the temperatures of the print head chips exceeds a predetermined limit, and thus, inferior printing quality may result if the printing operation were to be allowed to continues. Accordingly, the printing head chips are converted to the standby mode so as to stop the printing operation, and operation 500 is performed.

Otherwise, if in operation 508, the difference is found to be below the first threshold value $Th_1$, it is determined whether the lowest frequency $F_{min}$ is equal to or below a second threshold value $Th_2$, in operation 512. The second threshold value $Th_2$ may be chosen so as to determine whether to place the print head chips in the standby mode. If in operation 512 the lowest frequency $F_{min}$ is equal to or below a second threshold value $Th_2$, operation 510 is performed so as to place the print head chips in the standby mode. The lowest frequency $F_{min}$ being equal to or below a second threshold value $Th_2$ means that the print head chip having the highest temperature exceeds the limit of the critical temperature of performing a normal printing operation. Accordingly, if the lowest frequency $F_{min}$ (i.e. the highest temperature) is equal to or above the second threshold value $Th_2$, the printing operation stops, and the print head chips are placed in the standby mode.

Otherwise, if in operation 512 the lowest frequency $F_{min}$ is not equal to or below the second threshold value $Th_2$, the print head chip having a predetermined frequency is determined, and an ejection command is controlled based on the print head chip having the predetermined frequency, in operation 514. For example, a print head chip having the lowest frequency $F_{min}$ is determined as the print head chip having the predetermined frequency, and the ejection command is controlled based on the print head chip having the lowest frequency $F_{min}$, i.e., the print head chip having the highest temperature.

As previously described, the timing of the ejection command is controlled based on the temperature of the print head chip having the highest temperature. That is, if the print head chip having the highest temperature is selected as the reference head chip, the controller 400 may delay or advance the timing of the ejection command based on the temperature of the print head chip having the highest temperature. As the temperature of the print head chip becomes higher and higher, there is the possibility that the drop volume may increase, and thus the printing speed should be decreased so that the temperature does not continue to rise. In that case, the controller 400 further delays the timing of the ejection command. On the other hand, however, as the temperature of a print head chip becomes lower and lower, the drop volume may decrease, and thus the printing speed should be increased so that the temperature does not continue to decrease. Accordingly, the controller 400 in that situation further advances the timing of the ejection command.

For example, the controller 400 may control the timing of the ejection commands as previously described above in reference to FIG. 4.

In operation 514, the feeding speed of a printing medium may also be controlled based on the print head chip having the predetermined frequency as also previously described.

The methods according to the above embodiments may be realized as computer readable codes/instructions/programs. The embodiments herein described can be written as codes/instructions/programs and can be implemented in a general purpose computers that execute the codes/instructions/programs using a computer readable recording medium. Examples of the computer readable recording medium include magnetic storage media (e.g., ROM, floppy disks, hard disks, etc.), optical recording media (e.g., CD-ROMs, or DVDs), and storage media such as carrier waves (e.g., transmission through the Internet). The computer readable recording medium can also be distributed over network coupled computer systems so that the computer readable code is stored and executed in a distributed fashion.

While the disclosure has been particularly shown and described with reference to several embodiments thereof with particular details, it will be apparent to one of ordinary skill in the art that various changes may be made to these embodiments without departing from the principles and spirit of the invention, the scope of which is defined in the following claims and their equivalents.

What is claimed is:

1. An apparatus for controlling jetting of ink of an inkjet printer, comprising:

at least one print head chip, which comprises a temperature sensor for sensing temperature and a voltage controlled oscillator (VCO) for converting the sensed temperature to a frequency component;

a counter configured to convert the frequency component to a code information; and a controller configured to advance or delay the timing of ink ejection by the at least one print head chip based on the code information;

wherein when the temperature is above a predetermined temperature the controller advances or delays timing of ink election and when the temperature is below the predetermine temperature the controller performs the opposite ejection time control as to when the temperature is above the predetermined temperature.

2. The apparatus of claim 1, wherein the at least one print head chip comprises a plurality of print head chips, the apparatus further comprising:

a comparator configured to compare respective code information corresponding to each of the plurality of print head chips, wherein the controller controls the timing of ink ejection for one or more of the plurality of print head chips based on the code information corresponding to a select one of the plurality of print head chips selected based on the result of the comparison by the comparator.

3. The apparatus of claim 2, wherein the controller controls a feeding speed of a printing medium based on the code information.

4. The apparatus of claim 1, wherein the temperature sensor comprises a complimentary metal-oxide-semiconductor (CMOS) lateral bipolar junction transistor (BJT).

5. An apparatus for controlling letting of ink of an inkjet printer, comprising:

at least one print head chip, which comprises a temperature sensor for sensing temperature and a voltage controlled oscillator (VCO) for converting the sensed temperature to a frequency component;

a counter configured to convert the frequency component to a code information; and a controller configured to advance or delay the timing of ink election by the at least one print head chip based on the code information;

at least one print head chip comprises a plurality of print head chips, the apparatus further comprising:

a comparator configured to compare respective code information corresponding to each of the plurality of print head chips, wherein the controller controls the timing of ink election for one or more of the plurality of print head chips based on the code information corresponding to a select one of the plurality of print head chips selected based on the result of the comparison by the comparator; and wherein the controller delays the timing of ink ejection when the temperature of the select one of the plurality of print head chips is higher than a predetermined temperature, and advances the timing of ink ejection when the temperature of the select one of the plurality of print head chips is lower than the predetermined temperature.

6. An apparatus for controlling letting of ink of an inkjet printer, comprising:

at least one print head chip, which comprises a temperature sensor for sensing temperature and a voltage controlled oscillator (VCO) for converting the sensed temperature to a frequency component;

a counter configured to convert the frequency component to a code information; and a controller configured to advance or delay the timing of ink election by the at least one print head chip based on the code information;

at least one print head chip comprises a plurality of print head chips, the apparatus further comprising:

a comparator configured to compare respective code information corresponding to each of the plurality of print head chips, wherein the controller controls the timing of ink election for one or more of the plurality of print head chips based on the code information corresponding to a select one of the plurality of print head chips selected based on the result of the comparison by the comparator;

wherein the controller controls a feeding speed of a printing medium based on the code information; and wherein the controller decreases the feeding speed of the printing medium when the temperature of the select one of the plurality of print head chips is higher than a predetermined temperature, and increases the feeding speed of the printing medium when the temperature of the select one of the plurality of print head chips is lower than the predetermined temperature.

7. An apparatus for controlling letting of ink of an inkjet printer, comprising:

at least one print head chip, which comprises a temperature sensor for sensing temperature and a voltage controlled oscillator (VCO) for converting the sensed temperature to a frequency component;

a counter configured to convert the frequency component to a code information; and a controller configured to advance or delay the timing of ink election by the at least one print head chip based on the code information;

at least one print head chip comprises a plurality of print head chips, the apparatus further comprising:

a comparator configured to compare respective code information corresponding to each of the plurality of print head chips, wherein the controller controls the timing of ink election for one or more of the plurality of print head chips based on the code information corresponding to a select one of the plurality of print head chips selected based on the result of the comparison by the comparator; and wherein the controller determines whether a difference between the highest frequency and the lowest frequency from among frequencies corresponding to the plurality of print head chips is equal to or greater than a first threshold value, and, when it is determined that the difference is equal to or greater than the first threshold value, the controller causing the plurality of print head chips to switch to a standby mode.

8. An apparatus for controlling letting of ink of an inkjet printer, comprising:

at least one print head chip, which comprises a temperature sensor for sensing temperature and a voltage controlled oscillator (VCO) for converting the sensed temperature to a frequency component;

a counter configured to convert the frequency component to a code information; and a controller configured to advance or delay the timing of ink election by the at least one print head chip based on the code information;

at least one print head chip comprises a plurality of print head chips, the apparatus further comprising:

a comparator configured to compare respective code information corresponding to each of the plurality of print head chips, wherein the controller controls the timing of ink election for one or more of the plurality of print head chips based on the code information corresponding to a select one of the plurality of print head chips selected based on the result of the comparison by the comparator; and wherein the controller determines whether the lowest frequency from among frequencies corresponding to the plurality of print head chips is equal to or below a second threshold value, and when it is determined that the lowest frequency is equal to or below the second threshold value, the controller causing the plurality of print head chips to switch to a standby mode.

9. An image forming apparatus, comprising:

a plurality of print head chips, each of which comprises a temperature sensor for sensing temperature and a voltage controlled oscillator (VCO) for converting the sensed temperature to a frequency component;

a counter configured to convert each frequency component corresponding to respective one of the plurality of print head chips into a code information; and a controller configured to advance or delay the timing of ink ejection by the plurality of print head chips based the code information corresponding to at least one of the plurality of print head chips;

wherein when the temperature is above a predetermined temperature the controller advances or delays timing of ink election and when the temperature is below the predetermine temperature the controller performs the opposite election time control as to when the temperature is above the predetermined temperature.

10. A method of controlling jetting of ink of an inkjet printer, comprising:

sensing a temperature of at least one print head chip;

converting the sensed temperature into a frequency component;

converting the frequency component into a code information by using a reference frequency component; and advancing or delaying the timing of ink ejection by the at least one print head chip based on the code information;

wherein when the temperature is above a predetermined temperature the controller advances or delays timing of ink ejection and when the temperature is below the predetermine temperature the controller performs the opposite election time control as to when the temperature is above the predetermined temperature.

11. The method of claim 10, wherein the at least one print head chip comprises a plurality of print head chips, the method further comprising:

comparing respective code information corresponding to each of the plurality of print head chips, wherein the timing of ink ejection for one or more of the plurality of print head chips is controlled based on the code information corresponding to a select one of the plurality of print head chips selected based on the result of the comparison by the comparator.

12. The method of claim 11, further comprising:

controlling a feeding speed of a printing medium based on the code information.

13. A method of controlling jetting of ink of an inkjet printer, comprising:

sensing a temperature of at least one print head chip;

converting the sensed temperature into a frequency component;

converting the frequency component into a code information by using a reference frequency component; and advancing or delaying the timing of ink ejection by the at least one print head chip based on the code information;

wherein the at least one print head chip comprises a plurality of print head chips, the method further comprising:

comparing respective code information corresponding to each of the plurality of print head chips, wherein the timing of ink ejection for one or more of the plurality of print head chips is controlled based on the code information corresponding to a select one of the plurality of print head chips selected based on the result of the comparison by the comparator;

wherein the step of controlling the timing of ink ejection comprises:

delaying the timing of ink ejection when the temperature of the select one of the plurality of print head chips is higher than a predetermined temperature; and advancing the timing of ink ejection when the temperature of the select one of the plurality of print head chips is lower than the predetermined temperature.

14. A method of controlling jetting of ink of an inkjet printer, comprising:

sensing a temperature of at least one print head chip;

converting the sensed temperature into a frequency component;

converting the frequency component into a code information by using a reference frequency component; and advancing or delaying the timing of ink election by the at least one print head chip based on the code information;

controlling a feeding speed of a printing medium based on the code information;

wherein the at least one print head chip comprises a plurality of print head chips, the method further comprising:

comparing respective code information corresponding to each of the plurality of print head chips, wherein the timing of ink ejection for one or more of the plurality of print head chips is controlled based on the code information corresponding to a select one of the plurality of print head chips selected based on the result of the comparison by the comparator;

wherein the step of controlling the feeding speed of the printing medium comprises:

decreasing the feeding speed of the printing medium when the temperature of the select one of the plurality of print head chips is higher than a predetermined temperature; and increasing the feeding speed of the printing medium when the temperature of the select one of the plurality of print head chips is lower than the predetermined temperature.

15. A method of controlling letting of ink of an inkjet printer, comprising:

sensing a temperature of at least one print head chip;

converting the sensed temperature into a frequency component;

converting the frequency component into a code information by using a reference frequency component; and advancing or delaying the timing of ink election by the at least one print head chip based on the code information;

determining whether a difference between the highest frequency and the lowest frequency from among frequencies corresponding to the plurality of print head chips is equal to or greater than a first threshold value; and causing the plurality of print head chips to switch to a standby mode when the difference is determined to be equal to or greater than the first threshold value;

wherein the at least one print head chip comprises a plurality of print head chips, the method further comprising:

comparing respective code information corresponding to each of the plurality of print head chips, wherein the timing of ink ejection for one or more of the plurality of print head chips is controlled based on the code information corresponding to a select one of the plurality of print head chips selected based on the result of the comparison by the comparator.

16. A method of controlling jetting of ink of an inkjet printer, comprising:

sensing a temperature of at least one print head chip;

converting the sensed temperature into a frequency component;

converting the frequency component into a code information by using a reference frequency component; and advancing or delaying the timing of ink ejection by the at least one print head chip based on the code information;

determining whether the lowest frequency from among frequencies corresponding to the plurality of print head chips is equal to or below a second threshold value; and causing the plurality of print head chips to switch to a standby mode when the lowest frequency is determined to be equal to or below the second threshold value;

wherein the at least one print head chip comprises a plurality of print head chips, the method further comprising:

comparing respective code information corresponding to each of the plurality of print head chips, wherein the timing of ink election for one or more of the plurality of print head chips is controlled based on the code information corresponding to a select one of the plurality of print head chips selected based on the result of the comparison by the comparator.

17. A non-transitory computer readable recording medium having recorded thereon a program for executing a method of controlling jetting of ink of an inkjet printer, the method comprising:

sensing a temperature of at least one print head chip;

converting the sensed temperature into a frequency component;

converting the frequency component into a code information by using a reference frequency component; and advancing or delaying the timing of ink ejection by the at least one print head chip based on the code information;

wherein when the temperature is above a predetermined temperature the controller advances or delays timing of ink election and when the temperature is below the predetermine temperature the controller performs the opposite ejection time control as to when the temperature is above the predetermined temperature.

* * * * *